US009726415B1

(12) United States Patent
Spalti

(10) Patent No.: US 9,726,415 B1
(45) Date of Patent: Aug. 8, 2017

(54) INSULATED STORAGE SYSTEMS AND METHODS

(71) Applicant: Todd Spalti, Orcas, WA (US)

(72) Inventor: Todd Spalti, Orcas, WA (US)

( * ) Notice: Subject to any disclaimer, the term of this patent is extended or adjusted under 35 U.S.C. 154(b) by 182 days.

(21) Appl. No.: 14/883,542

(22) Filed: Oct. 14, 2015

Related U.S. Application Data

(63) Continuation of application No. 14/789,204, filed on Jul. 1, 2015, now abandoned.

(60) Provisional application No. 62/019,628, filed on Jul. 1, 2014.

(51) Int. Cl.

| | |
|---|---|
| ***F25D 3/08*** | (2006.01) |
| ***B65D 43/14*** | (2006.01) |
| ***B65D 43/22*** | (2006.01) |
| ***B65D 25/02*** | (2006.01) |

(52) U.S. Cl.
CPC ..... *F25D 3/08* (2013.01); *B65D 25/02* (2013.01); *B65D 43/14* (2013.01); *B65D 43/22* (2013.01)

(58) Field of Classification Search
CPC ..... F25D 3/08; B65D 25/02; B65D 43/22; B65D 43/14
See application file for complete search history.

(56) References Cited

U.S. PATENT DOCUMENTS 3,572,054 A * 3/1971 Curcio ..... F25D 3/08 62/389
3,971,231 A * 7/1976 Derry ..... F25D 3/12 62/388
4,515,421 A * 5/1985 Steffes ..... A45C 11/20 312/351
5,095,718 A * 3/1992 Ormond ..... A45F 3/04 206/427
5,605,056 A * 2/1997 Brown ..... A01K 97/04 312/210
5,816,433 A * 10/1998 Higgins ..... A45C 11/20 220/503
6,305,185 B1 * 10/2001 Sloan ..... A45C 5/14 62/235.1
6,357,252 B1 3/2002 Rand
6,619,768 B1 9/2003 Northrop et al.
6,782,711 B2 8/2004 Abfalter
7,284,393 B1 10/2007 Macmillan
7,357,271 B2 4/2008 Hase et al.
8,651,598 B2 2/2014 Go et al.
(Continued)

FOREIGN PATENT DOCUMENTS

TW 201313527 A 4/2013

*Primary Examiner* — Emmanuel Duke
(74) *Attorney, Agent, or Firm* — Michael R. Schacht; Schacht Law Offices, Inc.

(57) ABSTRACT

A cooler system comprising a cooler assembly and coolant material. The cooler assembly comprises a box, first and second doors, a lid, and a plate. The plate is arranged within the box member. When the cooler assembly is in a closed configuration, the box member, first and second door members, and the lid define a main chamber, at least portion of a front chamber portion of the main chamber is defined by the first and second doors, the partition, and the lid, at least a portion of a rear chamber portion of the main chamber is defined by the box, the partition, and the lid, and a port is formed between the plate and the lid to allow air flow between the front chamber portion and the rear portion. The coolant material is arranged within the rear chamber portion.

20 Claims, 13 Drawing Sheets

(56) References Cited

U.S. PATENT DOCUMENTS

| | | | | |
|---|---|---|---|---|
| 8,910,819 | B2 | 12/2014 | Seiders | |
| 2004/0093892 | A1* | 5/2004 | Abfalter | F25D 3/08 62/457.7 |
| 2004/0262319 | A1* | 12/2004 | Fisher | F25D 3/08 220/592.03 |
| 2006/0288730 | A1 | 12/2006 | Shill | |
| 2007/0137245 | A1 | 6/2007 | Ward | |
| 2008/0047868 | A1 | 2/2008 | Dege et al. | |
| 2012/0273505 | A1 | 11/2012 | Bose | |
| 2013/0068776 | A1* | 3/2013 | Patterson | A45F 3/46 220/592.01 |

* cited by examiner

INSULATED STORAGE SYSTEMS AND METHODS

RELATED APPLICATION

This application is a continuation of U.S. patent application Ser. No. 14/789,204 filed Jul. 1, 2015, currently pending, the contents of which is incorporated herein by reference in its entirety.

U.S. patent application Ser. No. 14/789,204 claims priority from U.S. Provisional Application Ser. No. 62/019,628 filed Jul. 1, 2014, the contents of which is incorporated herein by reference in its entirety.

TECHNICAL FIELD

The present invention relates to insulated storage systems and methods and, in particular, insulated storage systems and method having side, top, and bottom that are insulated to maintain a cool temperature inside the storage unit with the use of ice.

BACKGROUND

Coolers are typically formed by a rectangular, five-sided box with a lid covering the open sixth side of the box. Ice or other cooling material is arranged at the bottom of the cooler to cool items stored within the cooler. Shelves may be arranged within the box to keep items out of the ice and water from melted ice.

The need exists for improved systems and methods for keeping items cool.

SUMMARY

The present invention may be embodied as a cooler system comprising a cooler assembly and coolant material. The cooler assembly comprises a box, first and second doors, a lid, and a plate. The first and second doors are connected to the box by first and second hinges. The lid is connected to the box member by a third hinge. The plate is arranged within the box member. When the cooler assembly is in a closed configuration, the box member, first and second door members, and the lid define a main chamber, at least a portion of a front chamber portion of the main chamber is defined by the first and second doors, the partition, and the lid, at least a portion of a rear chamber portion of the main chamber is defined by the box, the partition, and the lid, and a port is formed between the plate and the lid to allow air flow between the front chamber portion and the rear portion. The coolant material is arranged within the rear chamber portion.

The present invention may also be embodied as a method of cooling items comprising the following steps. A cooler assembly is formed by rotatably connecting first and second door members to a box, rotatably connecting a lid to the box, and arranging a plate within the box such that, when the cooler assembly is in a closed configuration, the box, first and second doors, and the lid define a main chamber, at least a portion of a front chamber portion of the main chamber is defined by the doors, the plate, and the lid, and at least a portion of a rear chamber portion of the main chamber is defined by the box, the plate, and the lid. A port that allows air flow between the front chamber portion and the rear chamber portion. Coolant material is arranged within the rear portion of the box interior.

In one embodiment, the present invention may be a cooler system comprising a cooler assembly comprising a box member and first and second door members. A partition is arranged within the box member to divide the interior of the cooler assembly into front and rear portions. The door members may define or support one or more shelves. When the cooler assembly is in a closed configuration, the shelves are arranged within the front portion of the box interior. Ice or other coolant material is arranged within the rear portion to form the cooler system. A first type of goods to be cooled may be supported by the shelves in the front portion such that the first type of goods is separated from the ice arranged within the rear portion. A second type of goods may be placed in the ice within the rear portion.

In other embodiments, the present invention may be a cooler system comprising a cooler assembly comprising a box member, first and second door members, and a lid member. A partition is arranged within the box member to divide the interior of the cooler assembly into front and rear portions. The door members may define or support one or more shelves. When the cooler assembly is in a closed configuration, the shelves are arranged within the front portion of the box interior. The lid member engages the door members to inhibit flow of air between the lid member and the door members when the cooler assembly is in the closed configuration. Lifting the lid member allows access to the rear portion of the box interior. Ice or other coolant material is arranged within the rear portion to form the cooler system. A first type of goods to be cooled may be supported by the shelves in the front portion such that the first type of goods is separated from the ice arranged within the rear portion. A second type of goods may be placed in the ice within the rear portion.

The box member is insulated and may comprise or define a rear wall, a bottom wall, a first partial side wall, a second partial side wall, and a partial front wall. The partial front wall defines a part of a front wall of the entire cooler assembly when first and second doors are closed. When the first and second doors are open, the partial front wall defines a tray below shelves supported by the doors. Drain openings may be formed in one or more walls of the box member to allow liquid (e.g., water from melted ice) to be drained from the box interior. Plugs may be arranged to selectively close the drain openings. The box member may be made of a single insulating material (e.g., closed cell foam) or, more typically, a combination of materials (e.g., plastic shell for durability and foam core for insulation).

In one example, first and second doors are vertically hinged to the first and second partial side walls, respectively. The doors may be wrap around doors that define at least a portion of the side of the cooler assembly and at least a portion of the front of the cooler assembly. The vertical hinge or hinges may be formed by cast "piano" style hinges. Like the box member, the doors may be made of a single insulating material (e.g., closed cell foam) or, more typically, a combination of materials (e.g., plastic shell for durability and foam core for insulation). The shelves may be integrally formed with the door member, rigidly connected to the door member, or detachably attached to the door member.

Shelves may be integrally molded into or detachably attached to the doors such that the shelves at least partly extend into the front portion of the box interior. Such shelves will typically be arranged above the tray formed by the box member. The dimensions and number of shelves will be determined by the dimensions of the cooler assembly and the type of items to be stored on the shelves.

In one example, the lid is horizontally hinged. The horizontal hinge may be formed by cast "piano" style hinges. The lid may define a lip that extends over a portion of the doors when the cooler assembly is in the closed configuration. Lifting the lid allows access to the rear portion to allow introduction of ice and the second type of goods into the rear portion and removal of the second type of goods from the rear portion. Like the box member and door member(s), the doors may be made of a single insulating material (e.g., closed cell foam) or, more typically, a combination of materials (e.g., plastic shell for durability and foam core for insulation).

In one example, the partition is a flat plate that is substantially vertical when arranged within the box interior to define the front and rear portions. The partition separates ice within the rear portion from the front portion of the box interior. The partition may extend only partly along the box interior to form a gap that allows air flow over the top of the partition between the front and rear portions of the box interior. A temperature sensor may be arranged within and/or supported by a recess formed in the partition. The partition may be made of an insulating material like the box member, door(s), and lid but is more likely to be made of a non-insulating waterproof material such as plastic. The partition may be integrally formed with the box member, rigidly connected to the box member, or detachably attached to the box member.

Shelves may be arranged on one or both sides of the partition. Typically, shelves will be formed on the partition such that the shelves at least partly extend into the front portion of the box interior. The partition shelves may be vertically aligned with the door shelves or vertically misaligned with the door shelves. If the partition door shelves are vertically aligned with the partition shelves, the depth of the partition shelves should be coordinated with the depth of the door shelves such that the partition shelves do not interfere with door shelves when the door(s) are closed.

The doors may extend along only a portion of the front surface such that the bottom bin or tray is defined at the lower end of the front portion below the shelves.

The lid and doors may be hinged to open independently. Alternatively, the lid may be arranged to overlap a portion of the doors such that the doors may not be opened without first opening the lid.

A recess may be formed in a bottom surface of the box member to facilitate centering of the box member on and securing of the box member to an optional wheeled base to facilitate movement of the cooler assembly. The recess may take the form of an X-shape extending between the four corners of the bottom wall of the box member.

A circulation fan may be provided to circulate cool air from the rear portion of the box interior containing ice or other cooling material to the front portion of the box interior. The circulation fan may be arranged within and/or supported by a recess formed in the lid.

At least one of the temperature sensor and the circulation fan may be connected to a controller that operates the fan based on a temperature signal generated by the temperature sensor. The controller may be connected to a remote device such as a smart phone or computer to send status signals indicative of conditions within the box interior such as temperature and status of ice or cooling material.

One or more latches may be provided to secure the box assembly in the closed or partially open configurations. In one example, first and second latches extend from the lid to each of first and second doors, respectively. The latches may take the form of flexible T-latches that have a horizontal portion connected to and overlapping the lid and a vertical portion connected to and overlapping the door associated with each latch.

DETAILED DESCRIPTION

Figure 1:
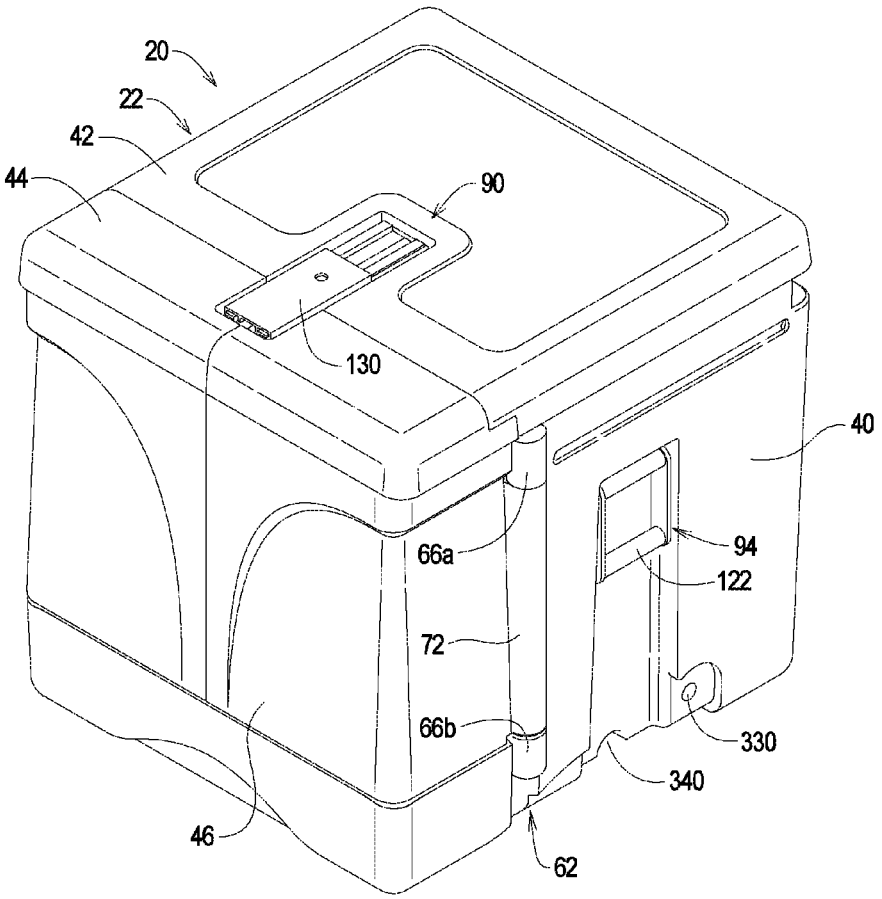
FIG. 1 is a front perspective view of a first example cooler system constructed in accordance with, and embodying, the principles of the present invention, the first example cooler being shown in closed, latched configuration.
Figure 10:
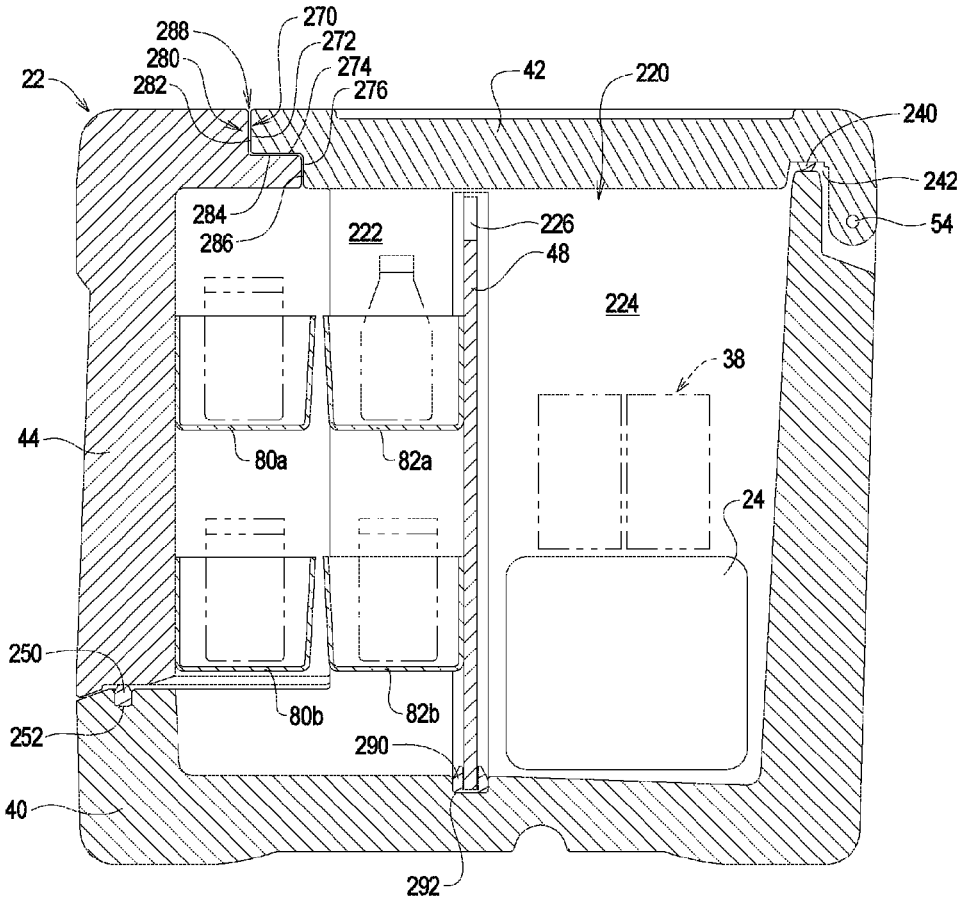
FIG. 10 is a section view taken along lines 10-10 in FIG. 5.
Figure 11:
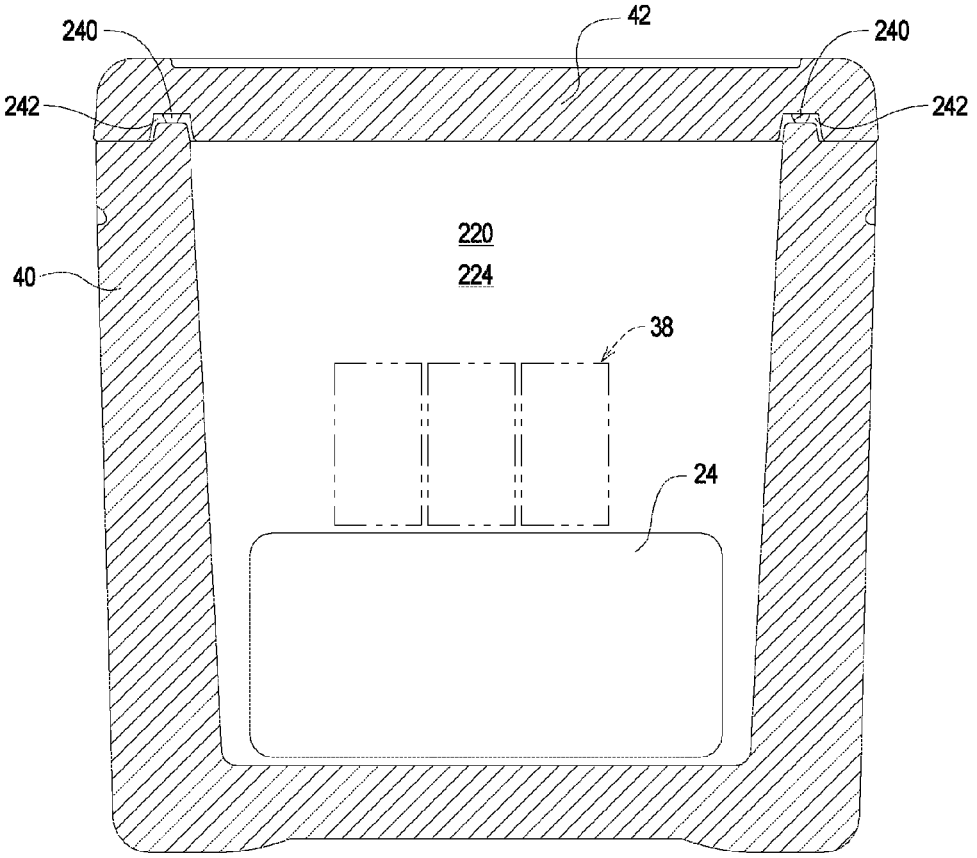
FIG. 11 is a section view taken along lines 11-11 in FIG. 4.
Figure 12:
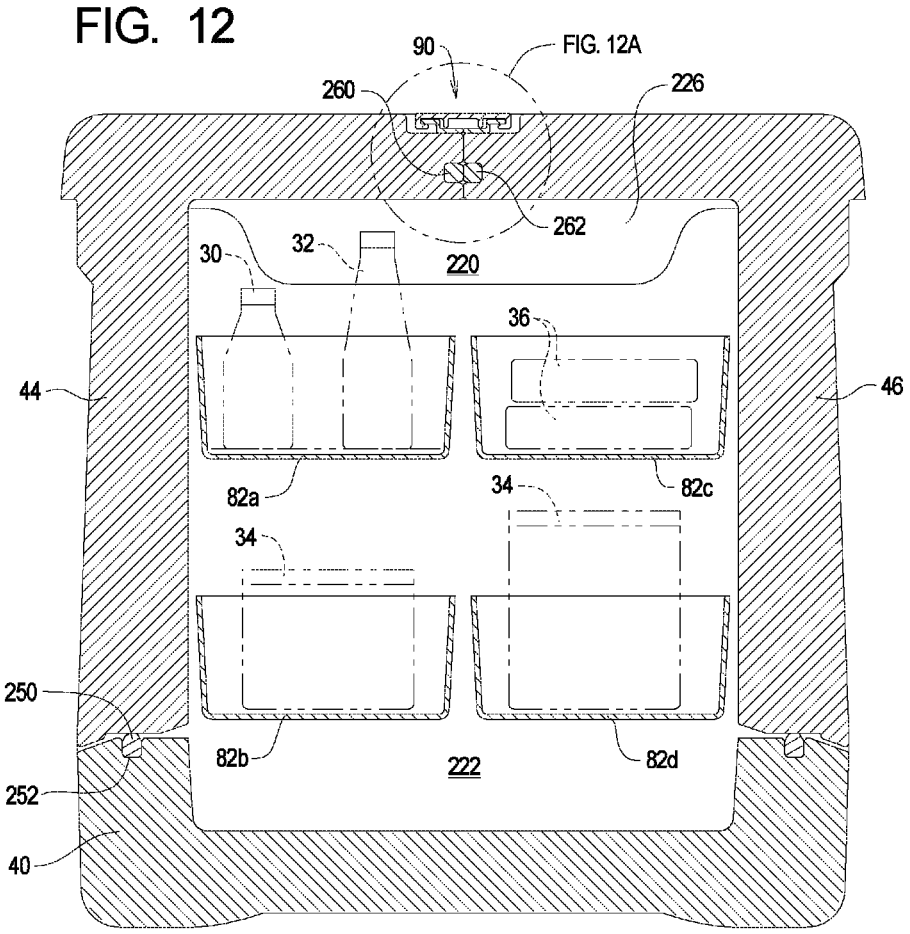
FIG. 12 is a section view taken along lines 12-12 in FIG. 4.

Referring initially to FIG. 1 of the drawing, depicted therein is an example cooler system 20 comprising a cooler assembly 22. As shown in FIGS. 10 and 11, the cooler system 20 further comprises a cooling material 24 as will be described in further detail below. And as shown in FIGS. 10-12, the example cooler system 20 is configured to store items of various sizes and shapes such as items 30, 32, 34, 36, and 38. The stored items 30, 32, 34, 36, and 38 are shown by way of example only, do not form a part of the example cooler system 20, and will be described herein only to that extent necessary for a complete understanding of the present invention.

Figure 2:
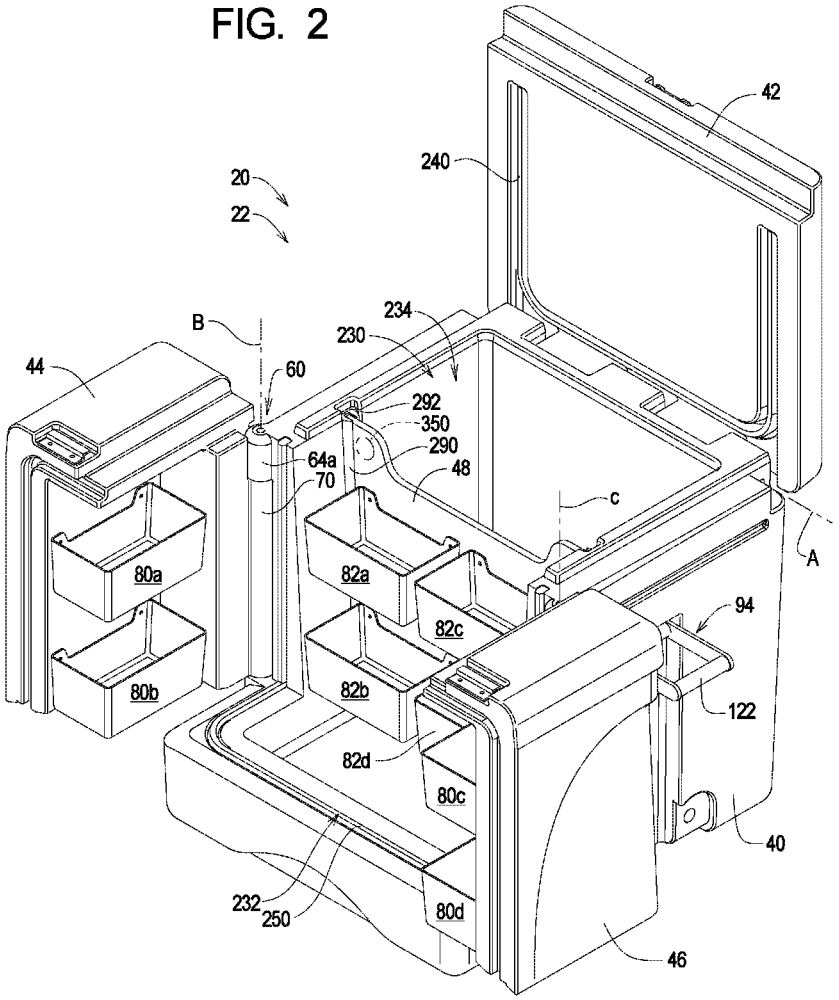
FIG. 2 is a front perspective view of the first example cooler system in an unlatched, open configuration.

Referring now to FIGS. 1 and 2, it can be seen that the example cooler assembly 22 comprises a box 40, a lid 42, left and right doors 44 and 46, and partition or plate 48. A comparison of FIGS. 1 and 2 illustrates that the lid 42 is rotatably supported by the box 40 for rotation about a first axis A and that the left and right doors 44 and 46 are rotatably supported by the box member for rotation about second and third axes B and C, respectively. During normal use of the example cooler assembly 22, the first axis A will be substantially horizontal, and the first and second axes B and C will be substantially vertical.

Figure 7:
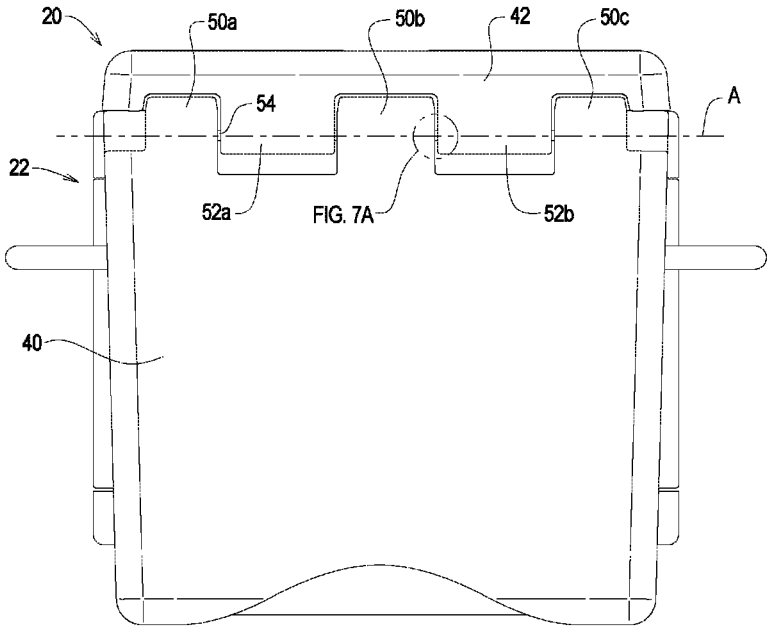
FIG. 7 is a rear elevation view of the first example cooler system in a closed configuration.

Referring for a moment to FIG. 7, it can be seen that one or more box rear hinge portions 50 are formed on the example box 40 and that the first axis A extends through the rear box hinge portions 50. In addition, one or more lid hinge portions 52 are formed on the example lid 42 such that, when the lid 42 is attached to the box 40 as shown in FIG. 7, the first axis A also extends through the one or more lid hinge portions 52. The example box 40 defines first, second, and third rear hinge portions 50*a*, 50*b*, and 50*c*, while the example lid 42 defines first and second lid hinge portions 52*a* and 52*b*. The example first lid hinge portion 52*a* engages the first and second rear hinge portions 50*a* and 50*b*, while the second lid hinge portion 52*b* engages the second and third rear hinge portions 50*b* and 50*c*.

Figure 6:
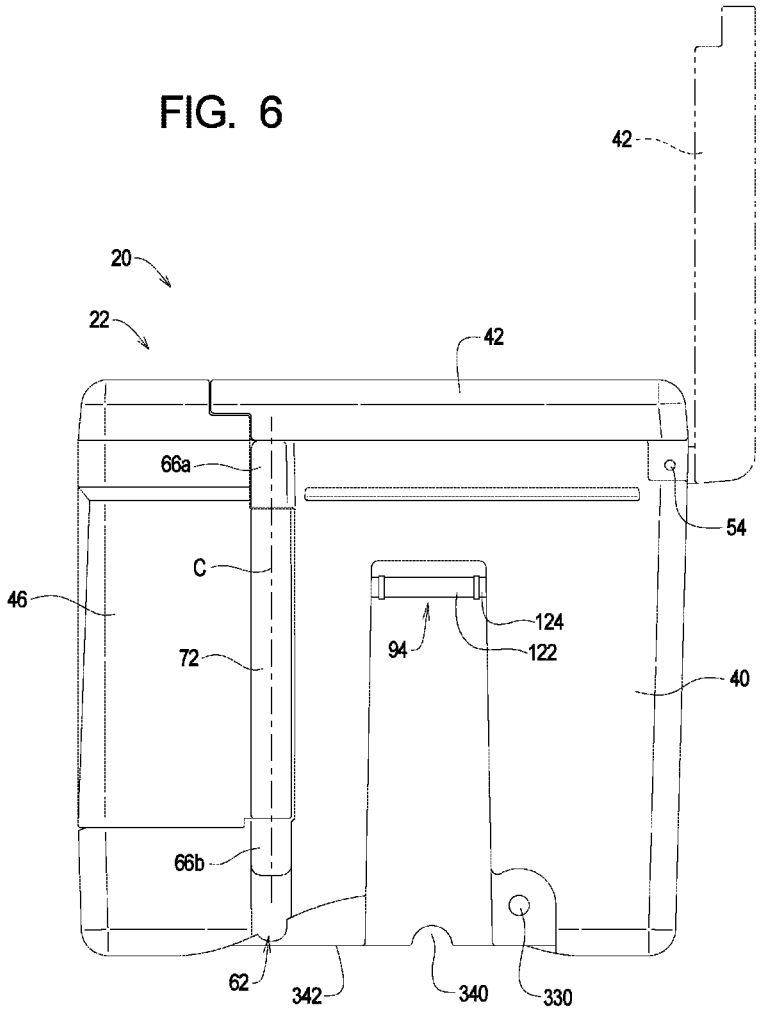
FIG. 6 is a side elevation view of the first example cooler system with a lid thereof in an open position.
Figure 7A:
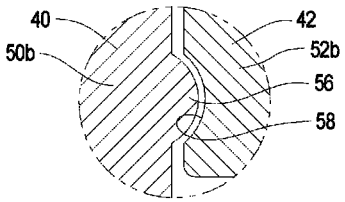
FIG. 7A is a section view of hinge system of a second example cooler system of the present invention.

In the example cooler assembly 22, a hinge pin 54 as shown in FIGS. 6, 7, and 10 is extended through openings in the hinge portions 50 and 52 such that the hinge pin is aligned with the first axis A and rotatably attaches the lid 42 to the box 40. Alternatively and/or in addition, the box 40 and lid 42 may be molded of semi-rigid but resilient material that is capable of slight deflection without failure of the material. In this case, complementary spherical or cylindrical projections 56 and recesses 58 may be formed on the hinge portions 50 and 52, as shown in the close up section view of FIG. 7A, such that, when the lid hinge portions 52 are forced into place between the rear hinge portions 50 as shown in FIG. 7, the recesses 58 receive the projections 56 to secure the lid 42 to the box 40 but allow rotation of the lid 42 relative to the box 40 as shown in FIGS. 1 and 2.

Referring now to FIGS. 1, 2, and 6, it can be seen that the example box 40 defines left and right hinge sets 60 and 62 each comprising an left and right side hinge portions 64 and 66. The second axis B extends through the at least one left hinge portion 64 in the left hinge set 60, and the third axis C extends through the at least one right hinge portion 66 in the right hinge set 62. The example first door 44 defines at least one left door hinge portion 70, and the example second door 46 defines at least one second door hinge portion 72. When the left door 44 is attached to the box 40 as shown in FIG. 2, the second axis B also extends through the least one left door hinge portion 70. Similarly, when the right door 46 is attached to the box 40 as shown in FIG. 6, the third axis C also extends through the least one right door hinge portion 72. The left hinge set 60 of the example box 40 defines first and second left side hinge portions 64*a* and 64*b*, while the right hinge set 62 of the example box 40 defines a first and second right side hinge portions 66*a* and 66*b*. In the example cooler assembly 22, a single left door hinge portion 70 and right door hinge portion 72 are used.

As with the example box 40 and lid 42, door hinge pins 74 and 76 (FIG. 8) are extended through openings in the hinge portions 64, 66, 70, and 72 such that the door hinge pins 74 and 76 are aligned with the second and third axes B and C, respectively, and rotatably attach the doors 44 and 46 to the box 40. Alternatively and/or in addition, the left and right example doors 44 and 46 may be molded of semi-rigid but resilient material that is capable of slight deflection without failure of the material. Accordingly, complementary spherical or cylindrical projections and recesses such as 56 and 58 discussed above may be formed on the hinge portions 64, 66, 70, and 72. Accordingly, the door hinge portions 70 and 72 are forced into place between the left side hinge portions 64 and right side hinge portions 66, respectively. At this point, the recesses receive the projections to secure the doors 44 and 46 to the box 40 but allow rotation of the doors 44 and 46 relative to the box 40 as shown in FIGS. 1 and 2.

FIG. 2 also shows that the example cooler assembly 22 further comprises a plurality of door trays 80 and plate trays 82. In particular, the example cooler assembly 22 comprises first and second door trays 80*a* and 80*b* supported by the example left door 44, third and fourth door trays 80*c* and 80*d* supported by the example right door 46, and first, second, third, and fourth plate trays 82*a*, 82*b*, 82*c*, and 82*d* supported by the example plate 48. The first and second door trays 80*a* and 80*b* may be integrally formed with, rigidly attached to, or detachably attached to the left door 44. The third and fourth door trays 80*c* and 80*d* may be integrally formed with, rigidly attached to, or detachably attached to the right door 46. The plate trays 82*a*, 82*b*, 82*c*, and 82*d* may be integrally formed with, rigidly attached to, or detachably attached to the tray plate 48. The exact shape, number, and location of door trays 80 and plate trays 82 may be varied depending on environmental conditions.

As shown in FIGS. 1 and 2, the example cooler assembly 22 further comprises a latch system 90 and first and second handles 92 and 94. The latch member 90 is configured to allow the lid 42 to be attached to the doors 44 and 46 to secure the lid 42 and doors 44 and 46 in a closed configuration (e.g., FIG. 1) or to allow the lid 42 to be detached from the doors 44 and 46 to allow the lid 42, left door 44, and right door 46 to be rotated relative to the box 40 as shown in FIG. 2. The example handles 92 and 94 are supported by the box 40 to facilitate lifting of the cooler system 20.

The example handles 92 and 94 are formed by handle members 120 and 122 that are rotatably attached to handle supports 124 integrally formed with or rigidly connected to the box 40, only one handle support 124 is illustrated in FIG. 6 of the drawing. The handle members 120 and 122 are configured to be rotated in an extended position relative to the box 40 (e.g., FIG. 2) and rotated into a retracted position relative to the box (e.g., FIG. 1) when not in use. Alternatively, the handles 92 and 94 may be integrally formed with or molded into the box 40.

Figure 3:
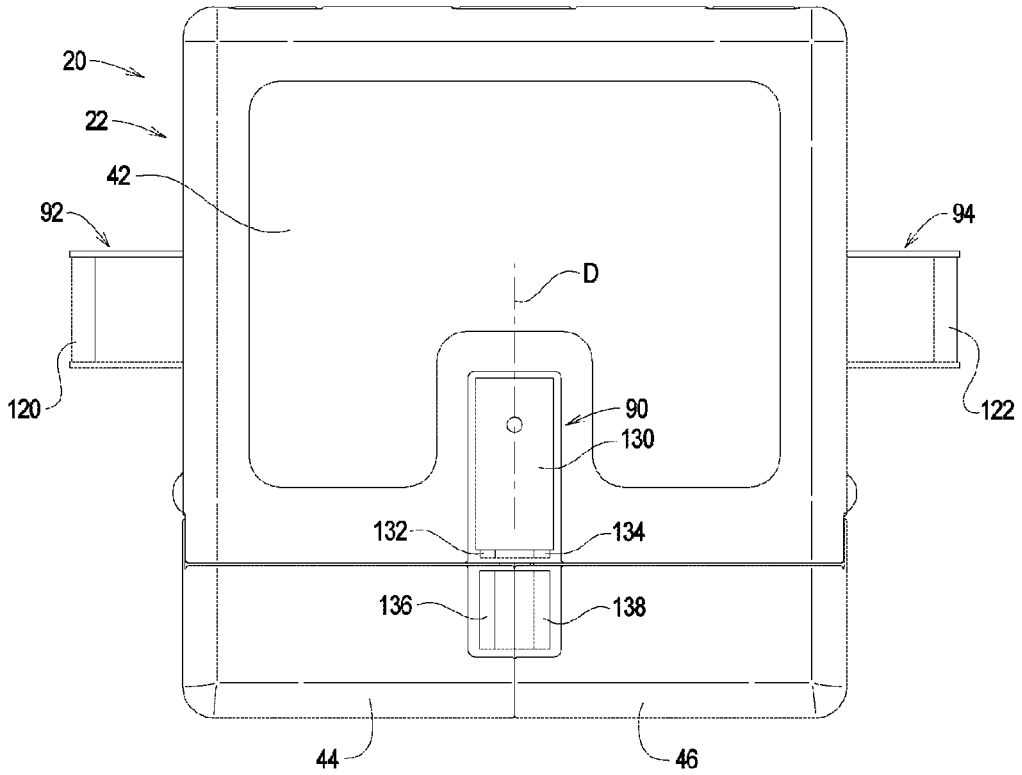
FIG. 3 is a top plan view of the first example cooler system in a closed, unlatched configuration.
Figure 4:
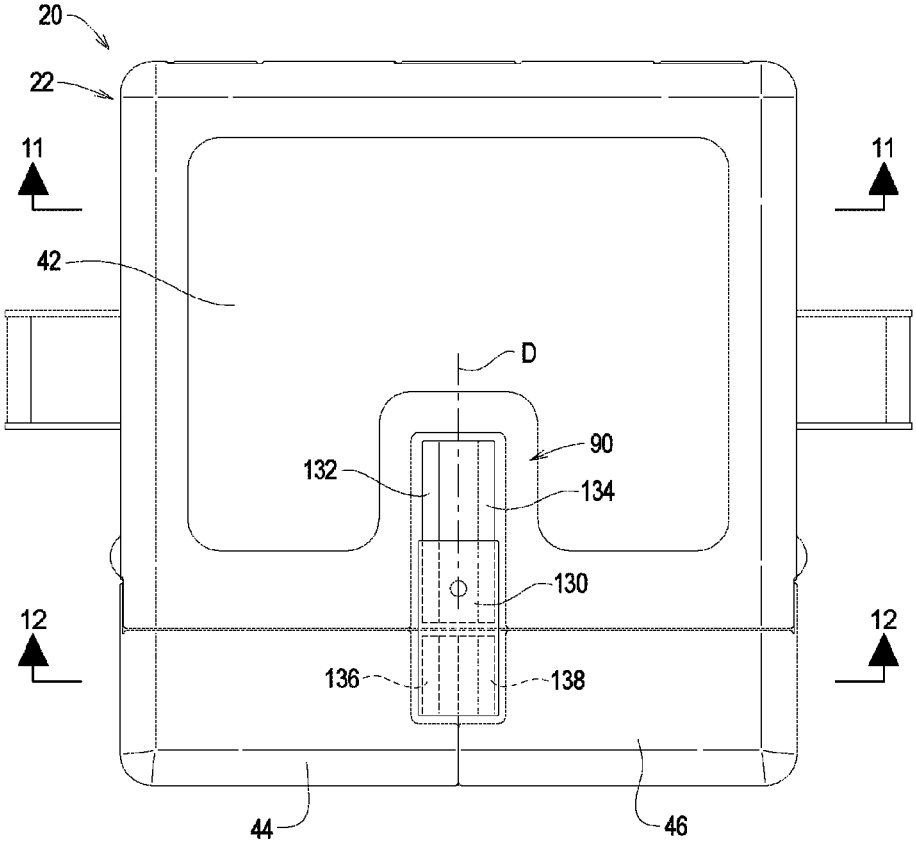
FIG. 4 is a top plan view of the first example cooler system in a closed, latched configuration.
Figure 5:
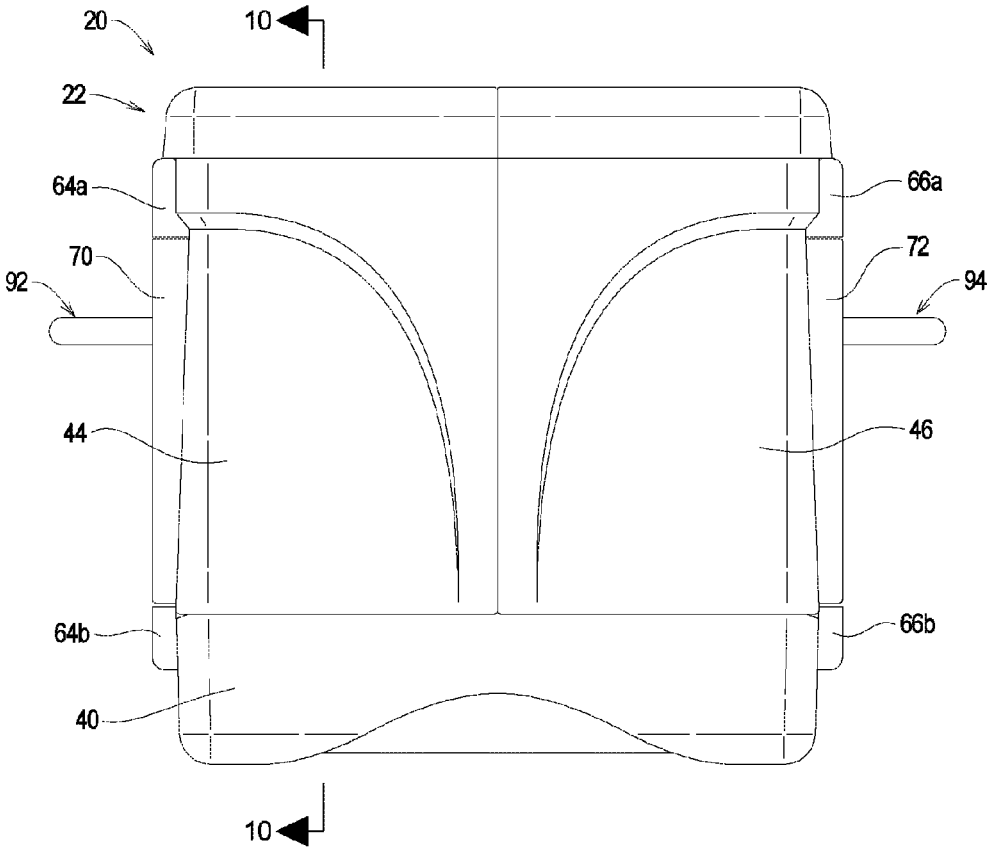
FIG. 5 is a front elevation view of the first example cooler system in a closed configuration.

As best shown in FIGS. 1, 3 and 4, the example latch system 90 comprises a latch member 130, first and second latch portions 132 and 134 supported by the lid 42, a third latch portion 136 supported by the left door 44, and a fourth latch portion 138 supported by the right door 46. The first and second latch portions 132 and 134 are supported in parallel with each other on other side of a latch axis D as shown in FIGS. 4 and 5. When the doors 44 and 46 are in the closed configuration (e.g., FIG. 1) the third and fourth latch portions 136 and 138 are adjacent to and aligned with the first and second latch portions 132 and 134, respectively, as perhaps best shown in FIG. 4. With the doors 44 and 46 closed, the third and fourth latch portions 136 and 138 are thus supported in parallel with each other on other side of the latch axis D as shown in FIG. 4. The latch member 130 is supported by the first and second latch portions 132 and 134 for linear movement along the latch axis D between an unlatched position (FIG. 3) and a latched position (FIG. 4).

When the latch system 90 is in an unlatched configuration (FIG. 3), the latch member 130 is entirely supported by the first and second latch portions 132 and 134 and does not engage the third and fourth latch portions 136 and 138. The doors 44 and 46 are thus capable of being rotated away from each other as shown in FIG. 2. To reconfigure the latch system 90 from the unlatched configuration to a latched configuration, the latch member 130 is displaced along the latch axis D such that the latch member 130 engages and is supported by third and fourth latch portions 136 and 138. In the latched configuration, the latch member 130 engages the first, second, third, and fourth latch portions 132, 134, 136, and 138 to prevent rotation of the doors 44 and 46 relative each other and out of the closed configuration as shown in FIG. 1.

Figure 12A:
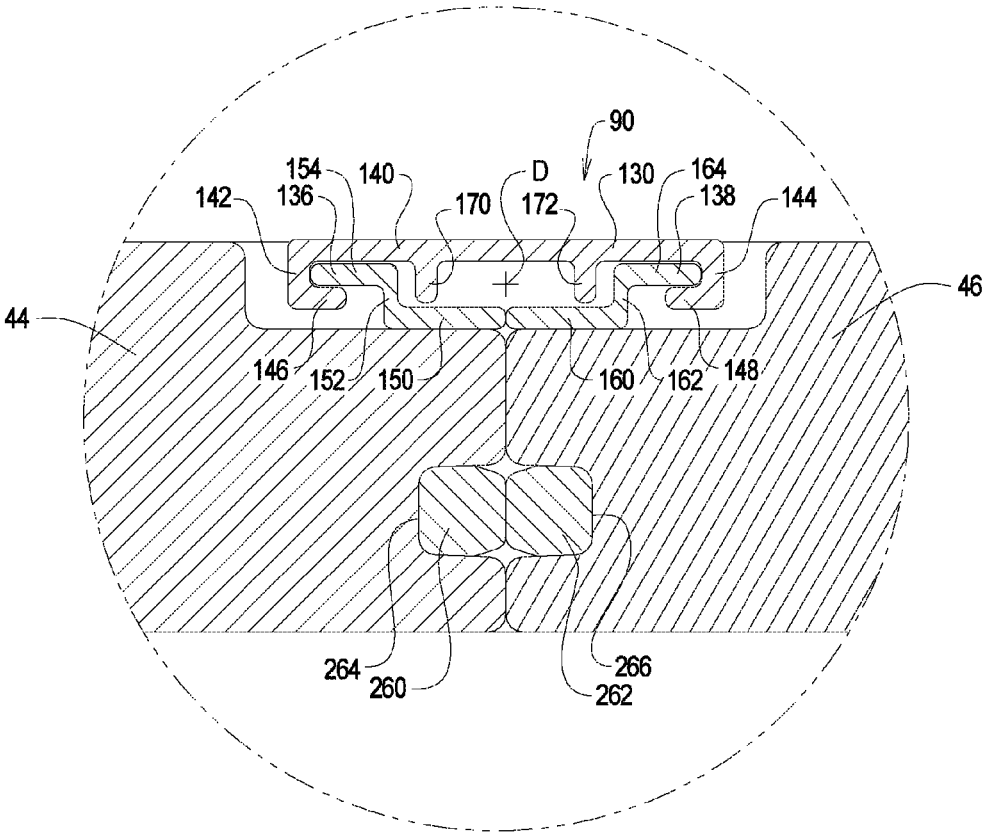
FIG. 12A is a detail view of FIG. 12.

More specifically as shown in FIG. 12A, the latch member 130 is generally in the shape of an inverted U with a base portion 140, first and second leg portions 142 and 144, and first and second rail portions 146 and 148. FIG. 12A also shows that the example third and fourth latch portions 136 and 138 take the form of L-shaped rails. The third latch portion 136 defines a base portion 150, an extension portion 152, and a third rail portion 154. The fourth latch portion 138 defines a base portion 160, an extension portion 162, and a fourth rail portion 164. The first and second latch portions 132 and 134 are not visible in FIG. 12A but have a shape generally similar to that of the third and fourth latch portions 136 and 138.

When the example latch system 90 is in the latched configuration, the first and second rail portions 146 and 148 engage the third and fourth rail portions 154 and 164, respectively, to inhibit movement of the latch member 130 in any direction except along the latch axis D. Further, when the latch system 90 is in the latched configuration, the third and fourth 154 and 164 engage the first and second leg portions 142 and 144 to prevent movement of the doors 44 and 46 relative to each other or to the box 40 and lid 42. Optionally, rib projections 170 and 172 may be formed on the base portion 140 of the latch member 130 such that these rib projections 170 and 172 are arranged between the extension portions 152 and 162 of the third and fourth latch portions 136 and 138 when the latch system 90 is in the latched configuration. The latch member 130 may use friction to keep it in the latched or unlatched positions and may further be configured to be positively held in its latched and unlatched positions by a cam or detent lock.

When the example cooler assembly 22 is in the closed configuration as shown, for example, in FIGS. 10, 11 and 12, the cooler assembly 22 defines a main chamber 220. As shown in FIGS. 2 and 10, the plate main chamber 220 is divided into a front chamber portion 222 and a rear chamber portion 224 when the plate 48 engages the box 40. At least a portion of the front chamber portion 222 is defined by the box 40, the first and second doors, the partition, and, when the example cooler assembly 22 is in the closed position, by the lid 42. At least a portion of the rear chamber portion 224 is defined by the box 40, the plate 48, and, when the example cooler assembly 22 is in the closed position, by the lid 42.

Figure 9:
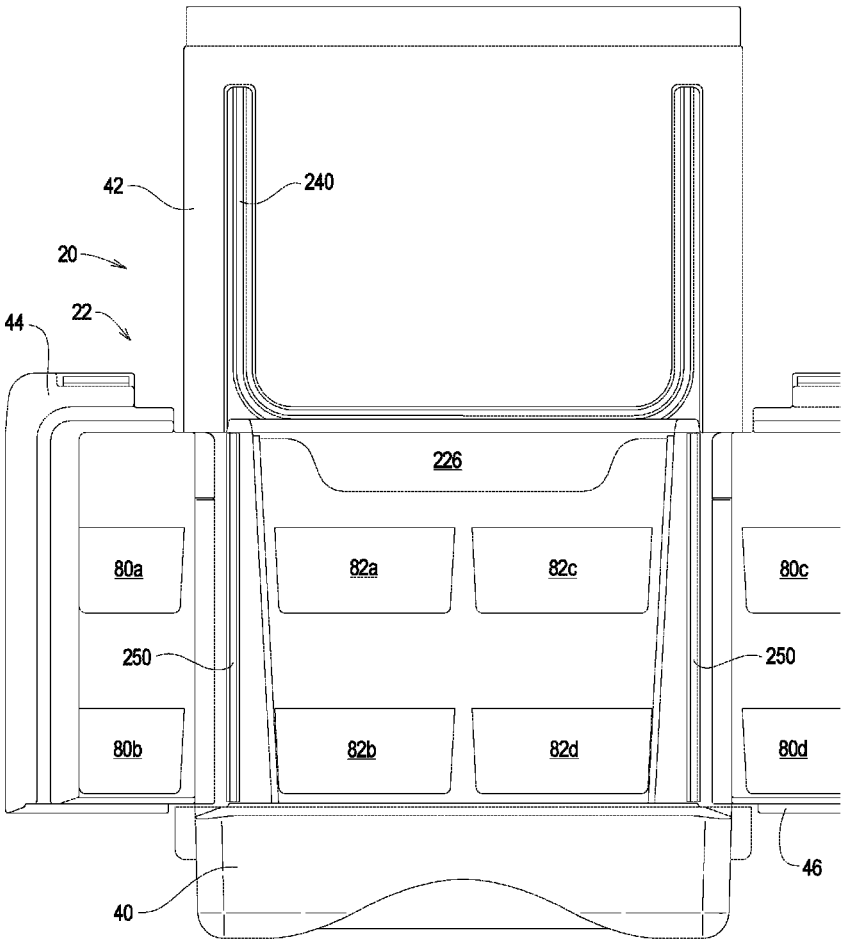
FIG. 9 is a front elevation view of the first example cooler system in a fully open configuration with the lid and left and right doors of the first example cooler system in their respective open positions.

As perhaps best shown in FIGS. 9, 10 and 12, the plate 48 is notched to define a cooling port 226 that allows the flow of air between the front chamber 222 and the rear chamber 224. When the cooler assembly 22 is in its open configuration, the main chamber 220 may be accessed through a main opening 230 defining a front portion 232 and an upper portion 234. The upper portion 234 of the main opening is closed by arranging the lid 42 in its closed position and opened by arranging the lid 42 is in its open position. The front portion 232 may be partly or fully closed by one or both of the left and right doors 44 and 46 when either of these doors 46 and 48 are rotated into their closed positions and partly or fully closed by one or both of the left and right doors 44 and 46 when either of these doors 46 and 48 are rotated into their open positions.

When the example cooler assembly 22 is in the closed configuration, gaps are formed between the box 40 and the lid 42, between the box 40 and the left door 44, between the box 40 and the right door 46, between the left door 44 and the lid 42, between the right door 44 and the lid 42, between the left door 44 and right door 46, and between plate 48 and the box 40. To provide mechanical stability and to inhibit air flow that would reduce the efficiency at which heat is prevented from entering the main chamber 220, several techniques may be used alone or in combination to seal these gaps. A first example technique is to provide a gasket that deforms when the edge of one component of the cooler assembly 22 is adjacent to another component of the cooler assembly 22 when the cooler assembly 22 is in the closed configuration. A second example technique is to configure the edges of adjacent components of the cooler assembly 22 such that air flow is inhibited between these edges when the cooler assembly 22 is in the closed configuration.

Figure 8:
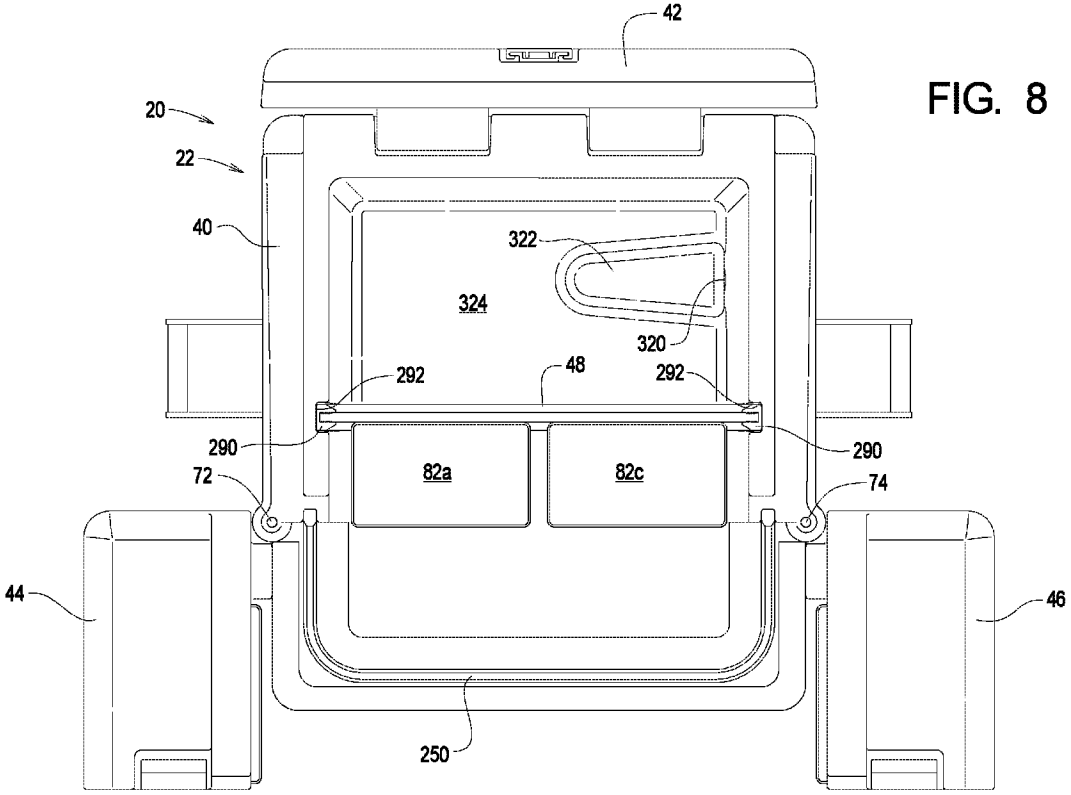
FIG. 8 is a top plan view of the first example cooler system in a fully open configuration with the lid and left and right doors of the first example cooler system in their respective open positions.

FIGS. 9, 10 and 11 illustrate a box/lid gasket 240 that is supported by friction or adhesive within a box/lid groove 242 in the lid 42 around the rear of the top portion 234 of the main opening 230. The example box/lid gasket 240 inhibits flow of air between the box 40 and the lid 42 when the lid 42 is in its closed position. FIGS. 8, 9 and 10 also illustrate a box/door gasket 250 that is supported by friction or adhesive within a box/door groove 252 in the box 40 around the front portion 232 of the main opening 230. The example box/door gasket 250 inhibits flow of air between the box 40 and the left and right doors 44 and 46 when these doors 44 and 46 are in their closed positions. FIGS. 12 and 12A further illustrate first and second door/door gaskets 260 and 262 that are supported by friction or adhesive within first and second door/door grooves 264 and 266 in the left and right doors 44 and 46, respectively. The example door/door gaskets 260 and 262 engage each other to inhibit flow of air between the left and right doors 44 and 46 when these doors 44 and 46 are in their closed positions. The various gaskets 240, 250, and 260 inhibit the penetration of heat into the main chamber 220.

FIG. 10 illustrates that an upper door edge 270 of the left door 44 defines a first door edge surface 272, a second door edge surface 274, and a third door edge surface 276. The right door 46 is not visible in the section view of FIG. 10 but similarly defines a door edge having first, second, and third door edge surfaces like the door edge surfaces 272, 274, and 276. FIG. 10 illustrates that a front lid edge 280 of the lid 42 defines a first lid edge surface 282, a second lid edge surface 284, and a third lid edge surface 286. During normal use, the first and third door edge surfaces 272 and 276 and the first and third lid edge surfaces 282 and 826 are substantially vertical, while the second door edge surface 274 and lid edge surface 284 are substantially horizontal. When closed, a gap 288 between the lid 42 and doors 44 and 46 is formed by the intersections of the surfaces 272 and 282, 274 and 284, and 276 and 286, respectively. The length of the overlapping surfaces areas defining the gap 288 decreases the ability of air to flow between the upper door edge 270 and the front lid edge 280, minimizing penetration of heat into the main chamber 220. The use of fairly tight manufacturing tolerances can further minimize the dimensions of the gap 288 and thus flow of air through this gap 288.

The plate 48 may be integrally formed with the box 40 but, for ease of manufacturing and cleaning, is typically a separate component that may be removed from the box 40. As shown in FIGS. 2, 8, and 10, a plate gasket 290 is secured to side and bottom edges of the example plate 48 and a U-shaped plate groove 292 is formed in the example box 40. The plate gasket 290 engages the plate groove 292 to inhibit the flow of liquids between the front and rear chamber portions 222 and 224 when the cooler assembly 22 is in its normal upright orientation.

FIG. 8 illustrates that a drain port 320 and associated sump area 322 may be formed in a bottom wall 324 of the box 40. The sump area 322 collects liquids on this bottom wall 324, and the drain port 320 allows these liquids to be drained to an exterior of the main chamber 220 without opening the lid 42 or inverting the box 40. A plug 330 (FIGS. 1 and 6) is accessible from an exterior of the box 40 and may be removed to allow the drain port 320 to be selectively opened or closed.

To use the cooler system 20, the cooling material 24 is typically arranged within the rear chamber portion 224. The cooling material 24 may be loose material such as ice or contained material such as bagged ice or commercially available freeze, gel, or ice packs containing frozen water or refrigerant gel. The use of the example plate gasket 290 and the example plate groove 292 inhibits the passage of water from melting ice, condensation, and other liquids from the rear chamber portion 224 to the front chamber portion 222. Typically, at least the lid 42 will be in its open configuration when the cooling material 24 is arranged in the rear chamber portion 224.

Before, after, or while the cooling material 24 is arranged within the rear chamber portion 224, the stored items 30, 32, 34, and 36 may be arranged within the front chamber portion 222. The tray members 80 and 82 are normally designed to support stored items such as condiments that may not be as susceptible to heat spoilage and/or stored items such as bread or sandwiches that are sensitive to spoilage by liquids. The plate 48 is designed separate the items stored in the front chamber portion 222 from any liquids collecting in the rear chamber portion 224. Typically, at least one or both of the left and right doors 44 and 46 will be in its open configuration when the stored items are arranged in the front chamber portion 222. The lid 42 may either be open or closed when the left and/or right doors 44 and 46 are opened to access stored items within the front chamber portion 222.

Before, after, or while the cooling material 24 is arranged within the rear chamber portion 224, the stored items 38 may be arranged within the rear chamber portion 224. The stored items 38 arranged within the rear chamber portion 224 are typically items such as contained beverages that are not spoiled by exposure to liquids. Typically, only the lid 42 needs to be arranged in its open configuration when the stored items are arranged in the rear chamber portion 224, but at least one or both of the left and right doors 44 and 46 may also be open as well.

Referring now back to FIGS. 1 and 6 of the drawing, it can be seen that a recess 340 may be formed in a bottom surface 342 of the box 40 to facilitate centering of the box 42 on and securing of the box 42 to an optional wheeled base (not shown) to facilitate movement of the cooler assembly. The recess 340 may take the form of an X-shape extending between the four corners of the bottom wall of the box member.

FIG. 2 illustrates that an optional circulation fan 350 may be provided to move cool air from the rear chamber portion 224 to the front chamber portion 222. The circulation fan 350 may be arranged within and/or supported by a recess formed the plate 48 or, optionally, in the lid 42.

A temperature sensor and controller packaged with the circulation fan 350 can be configured the fan 350 based on a temperature signal generated by the temperature sensor. The controller may further be connected to a remote device (not shown) such as a smart phone or computer to send status signals indicative of conditions within the box interior such as temperature and status of ice or cooling material. The functions of the circulation fan, temperature sensor, and controller may be integrated into a single physical enclosure as shown or embodied in separate physical enclosures.

Dimensions illustrated in the attached drawing are for point of reference only, and a cooler assembly of the present invention may be made in different sizes and configurations.

In addition, in this specification the use of a letter suffix with any reference character does not necessarily indicate that an element generically identified by that reference character is different from an element specifically identified by the reference character with a letter suffix. Accordingly, any reference character used without a letter suffix in the specification may generally refer to the same reference character used with a letter suffix in the drawing.

Further, the terms "front", "rear", "upper", "bottom", "left", and "right" are used herein are for convenience only and assume that the cooler assembly 22 is in its normal upright position.

What is claimed is:

1. A cooler system comprising:
- a cooler assembly comprising
  - a box,
  - a lid rotatably supported by the box, and
  - first and second doors rotatably supported by the box member,
  - a plate arranged within the box member, wherein
  - when the cooler assembly is in a closed configuration, the box member, first and second door members, and the lid define a main chamber,
  - at least portion of a front chamber portion of the main chamber is defined by the first and second doors, the partition, and the lid,
  - at least a portion of a rear chamber portion of the main chamber is defined by the box, the partition, and the lid, and
  - a port is formed between the plate and the lid to allow air flow between the front chamber portion and the rear portion; and
- coolant material arranged within the rear chamber portion.

2. The cooler system as recited in claim 1, in which:
- the lid rotates relative to the box about a first axis;
- the first door rotates relative to the box about a second axis; and
- the second door rotates relative to the box about a third axis; wherein
- the second and third axes are parallel to each other; and
- the first axis is orthogonal to the second and third axes.

3. The cooler system as recited in claim 1, further comprising a latch system supported by the lid and the first and second doors.

4. The cooler system as recited in claim 3, in which the latch system comprises:
- a latch member,
- at least one latch portion supported by the lid;
- at least one latch portion supported by the first door; and
- at least one latch portion supported by the second door; whereby
- when the latch member is in an unlatched position, the latch member engages the at least one latch portion supported by the lid and does not engage the at least one latch portion supported by the first door and the at least one latch portion supported by the second door; and
- when the latch member is in a latched position, the latch member engages the at least one latch portion supported by the lid, the at least one latch portion supported by the first door; and the at least one latch portion supported by the second door.

5. The cooler system as recited in claim 3, in which the latch system comprises:
- a latch member,
- first and second latch portions supported by the lid;

a third latch portion supported by the first door; and a fourth latch portion supported by the second door; whereby when the latch member is in an unlatched position, the latch member engages the first and second latch portions and does not engage the third latch portion or the fourth latch portion; and when the latch member is in a latched position, the latch member engages the first, second, third, and fourth latch portions.

6. The cooler system as recited in claim 5, in which the first, second, third, and fourth latch portions are configured to allow linear movement of the latch member between the unlatched and latched positions when the cooler assembly is in a closed configuration.

7. The cooler system as recited in claim 1, in which the plate is detachably attached to the box member.

8. The cooler system as recited in claim 7, further comprising:

a plate gasket supported by the plate; and a plate groove formed in the box member; whereby the plate groove receives the plate gasket to inhibit flow of liquid between the front chamber portion and the rear chamber portion.

9. The cooler system as recited in claim 1, further comprising:

at least one door tray supported by at least one of the first and second doors; and at least one plate tray supported by the plate; whereby the at least one door tray and the at least one plate tray are arranged in the front chamber portion when the cooler assembly is in a closed configuration.

10. A method of cooling items comprising the steps of:

forming a cooler assembly by providing a box, rotatably connecting first and second door members to the box, rotatably connecting a lid to the box, and arranging a plate within the box such that, when the cooler assembly is in a closed configuration, the box, first and second door members, and the lid define a main chamber, at least portion of a front chamber portion of the main chamber is defined by the doors, the plate, and the lid, and at least a portion of a rear chamber portion of the main chamber is defined by the box, the plate, and the lid, defining a port that allows air flow between the front chamber portion and the rear chamber portion; and arranging coolant material within the rear portion of the box interior.

11. The method as recited in claim 10, in which:

the lid rotates relative to the box about a first axis;

the first door rotates relative to the box about a second axis; and the second door rotates relative to the box about a third axis; wherein the second and third axes are parallel to each other; and the first axis is orthogonal to the second and third axes.

12. The method as recited in claim 10, further comprising the step of supporting a latch system on the lid and the first and second doors.

13. The method as recited in claim 12, in which the step of providing the latch system comprises the steps of:

supporting first and second latch portions on the lid;

supporting a third latch portion on the first door;

supporting a fourth latch portion on the second door;

when the latch member is in an unlatched position, arranging the latch member to engage the first and second latch portions and not the third latch portion or the fourth latch portion; and when the latch member is in a latched position, engaging the latch member with the first, second, third, and fourth latch portions.

14. The method as recited in claim 13, further comprising the step of configuring the first, second, third, and fourth latch portions to allow linear movement of the latch member between the unlatched and latched positions when the cooler assembly is in a closed configuration.

15. The method as recited in claim 10, further comprising the step of detachably attaching the plate to the box member.

16. The method as recited in claim 15, in which the step of detachably attaching the plate to the box member comprises the steps of:

supporting a plate gasket on the plate; and forming a plate groove in the box member; and displacing the plate such that the plate groove receives the plate gasket, thereby inhibiting flow of liquid between the front chamber portion and the rear chamber portion.

17. The method as recited in claim 10, further comprising steps of:

supporting at least one door tray on at least one of the first and second doors; and supporting at least one plate tray on the plate; whereby the at least one door tray and the at least one plate tray are arranged in the front chamber portion when the cooler assembly is in a closed configuration.

18. A cooler assembly for supporting coolant material and a stored item, comprising:

a box;

a lid supported by the box for rotation about a first axis;

first and second doors supported by the box member for rotation about second and third axes;

a plate arranged within the box member;

at least one door tray supported by at least one of the first and second doors; and at least one plate tray supported by the plate; whereby when the cooler assembly is in a closed configuration, the box member, the first and second door members, and the lid define a main chamber;

at least portion of a front chamber portion of the main chamber is defined by the first and second doors, the partition, and the lid;

at least a portion of a rear chamber portion of the main chamber is defined by the box, the partition, and the lid;

a port is formed between the plate and the lid to allow air flow between the front chamber portion and the rear portion;

the at least one door tray and the at least one plate tray are arranged in the front chamber portion when the cooler assembly is in a closed configuration;

the second and third axes are parallel to each other; and the first axis is orthogonal to the second and third axes.

19. The cooler system as recited in claim 18, further comprising a latch system comprising:

a latch member, first and second latch portions supported by the lid;

a third latch portion supported by the first door; and a fourth latch portion supported by the second door; whereby when the latch member is in an unlatched position, the latch member engages the first and second latch portions and does not engage the third latch portion or the fourth latch portion; and when the latch member is in a latched position, the latch member engages the first, second, third, and fourth latch portions.

20. The cooler system as recited in claim 18, further comprising:

a plate gasket supported by the plate; and a plate groove formed in the box member; whereby the plate groove receives the plate gasket to inhibit flow of liquid between the front chamber portion and the rear chamber portion.

* * * * *